US011812230B2

(12) United States Patent
Matsuda

(10) Patent No.: US 11,812,230 B2
(45) Date of Patent: Nov. 7, 2023

(54) MEASUREMENT METHOD AND MEASUREMENT APPARATUS

(71) Applicant: Yamaha Corporation, Hamamatsu (JP)

(72) Inventor: Ryo Matsuda, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 17/701,859

(22) Filed: Mar. 23, 2022

(65) Prior Publication Data

US 2022/0312137 A1 Sep. 29, 2022

(30) Foreign Application Priority Data

Mar. 24, 2021 (JP) ..... 2021-049451

(51) Int. Cl.

| | |
|---|---|
| ***H04R 29/00*** | (2006.01) |
| ***H04R 1/08*** | (2006.01) |
| ***H04R 1/40*** | (2006.01) |
| ***H04R 3/12*** | (2006.01) |

(52) U.S. Cl.

CPC ..... *H04R 29/002* (2013.01); *H04R 1/08* (2013.01); *H04R 1/403* (2013.01); *H04R 3/12* (2013.01)

(58) Field of Classification Search

None

See application file for complete search history.

(56) References Cited

U.S. PATENT DOCUMENTS

| | | | | |
|---|---|---|---|---|
| 2005/0137859 | A1* | 6/2005 | Yoshino | H04S 7/301 704/205 |
| 2008/0192957 | A1* | 8/2008 | Kubo | H04S 7/301 381/103 |
| 2016/0309276 | A1* | 10/2016 | Ridihalgh | G06F 3/165 |
| 2020/0015013 | A1 | 1/2020 | Kawai | |

FOREIGN PATENT DOCUMENTS

| | | | |
|---|---|---|---|
| EP | 1 534 047 | A2 | 5/2005 |
| EP | 1 956 865 | A2 | 8/2008 |
| WO | WO 2018/173131 | A1 | 9/2018 |

OTHER PUBLICATIONS

Extended European Search Report issued in European Application No. 22162666.6 dated Sep. 5, 2022 (10 pages).

* cited by examiner

*Primary Examiner* — Kenny H Truong
(74) *Attorney, Agent, or Firm* — Crowell & Moring LLP

(57) ABSTRACT

A measurement method includes generating a plurality of second measurement signals by disposing a plurality of first measurement signals corresponding to each of the plurality of speakers in respective different time zones on a time axis, generating a plurality of third measurement signals by copying a portion of a back end of each of the plurality of second measurement signals and adding the portion to a front end of each of the plurality of second measurement signals, outputting sounds according to each of the plurality of third measurement signals from each of the plurality of speakers, collecting the sounds with a microphone, and calculating a plurality of impulse responses corresponding to (Continued)

the plurality of first measurement signals, based on the collected sound signal collected with the microphone and the plurality of third measurement signals.

14 Claims, 8 Drawing Sheets

⋮

⋮

MEASUREMENT METHOD AND MEASUREMENT APPARATUS

CROSS-REFERENCE TO RELATED APPLICATIONS

This application claims priority to Japanese Application No. 2021-049451, filed on Mar. 24, 2021, the entirety of which is incorporated herein by reference in its entirety.

BACKGROUND

Technical Field

An embodiment of the present disclosure relates to a method and apparatus for measuring an impulse response.

Background Information

International Publication No. 2018/173131 discloses outputting a measurement sound from each of a plurality of speakers, and measuring acoustic characteristics of each of the plurality of speakers. A measurement result is used for adjustment of frequency characteristics, output timing, or a volume level, for example.

A conventional measurement method outputs a measurement sound sequentially from each of a plurality of speakers. Therefore, as the number of speakers is increased, the number of times of measurement increases and the measurement time increases.

SUMMARY

In view of the foregoing, an object of an embodiment of the present disclosure is to provide a measurement method and a measurement apparatus that reduce an increase in the number of times of measurement even when the number of speakers is increased.

A measurement method according to an embodiment of the present disclosure include generating a plurality of second measurement signals by disposing a plurality of first measurement signals corresponding to each of the plurality of speakers in respective different time zones on a time axis, generating a plurality of third measurement signals by copying a portion of a back end of each of the plurality of second measurement signals and adding the portion to a front end of each of the plurality of second measurement signals, outputting sounds according to each of the plurality of third measurement signals from each of the plurality of speakers, collecting the sounds with a microphone, and calculating a plurality of impulse responses corresponding to the plurality of first measurement signals, based on the collected sound signal collected with the microphone and the plurality of third measurement signals.

According to an embodiment of the present disclosure, even when the number of speakers is increased, an increase of the number of times of measurement is able to be reduced.

DETAILED DESCRIPTION

Figure 1:
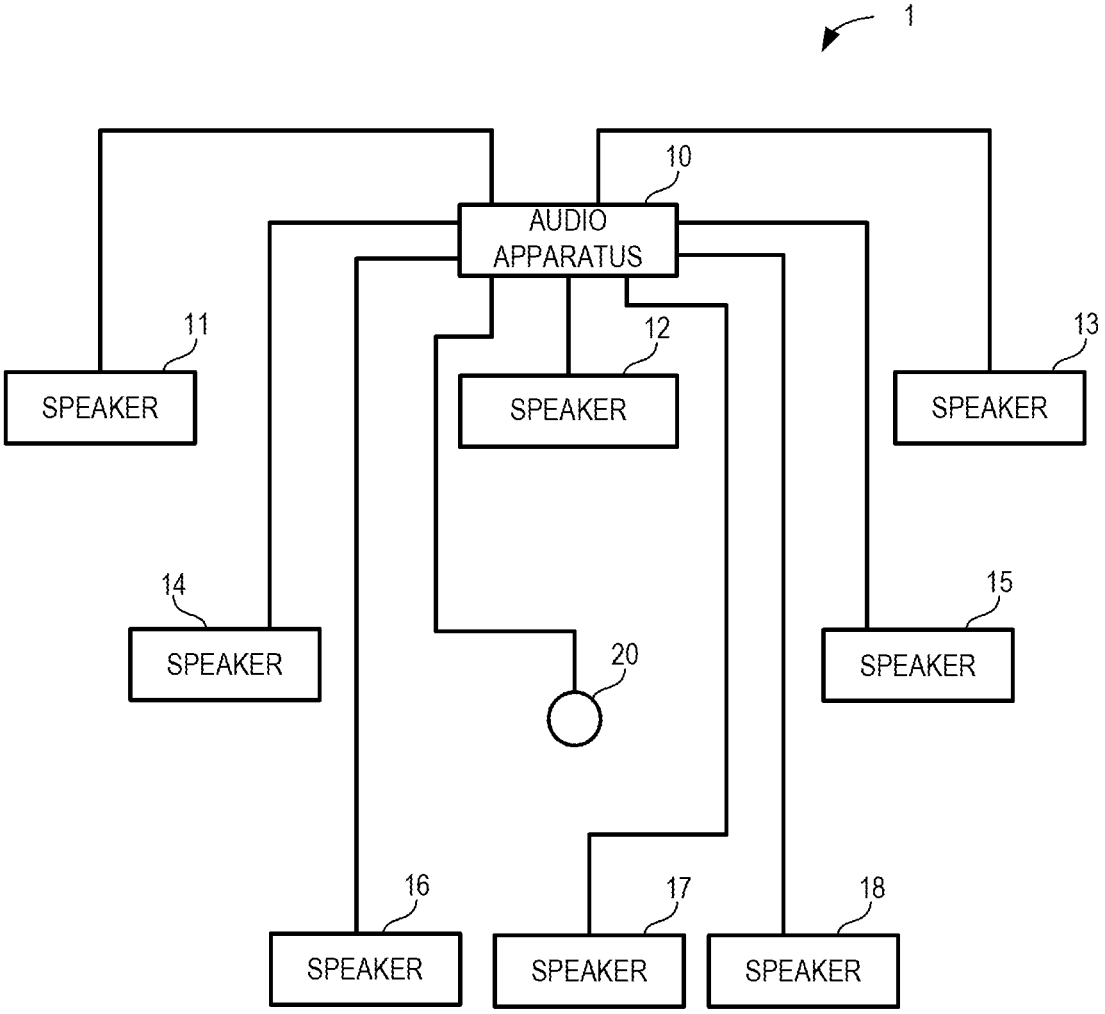
FIG. 1 is a block diagram showing a configuration of a measurement system.

FIG. 1 is a block diagram showing a configuration of a measurement system 1 according to various embodiments of the present disclosure. The measurement system 1 includes an audio device 10, a microphone 20, and a plurality of speakers 11 to 18. The audio device 10 is connected to the microphone 20 and the plurality of speakers 11 to 18, through audio cables. However, the audio device 10 may be connected to the microphone 20 and the plurality of speakers 11 to 18 by wireless communication.

The audio device 10 receives an audio signal from a content reproduction apparatus such as a television or a player. In addition, the audio device 10 may receive content data from a server or the like through the Internet. The audio device 10, in a case of receiving content data, decodes the content data and takes out an audio signal.

The audio device 10 outputs the audio signal to the speakers 11 to 18. The audio device 10 performs signal processing on the audio signal to be supplied to each speaker, according to the acoustic characteristics of each of the speakers 11 to 18. The signal processing includes adjustment of frequency characteristics, adjustment of output timing, or adjustment of a volume level, for example.

Figure 2:
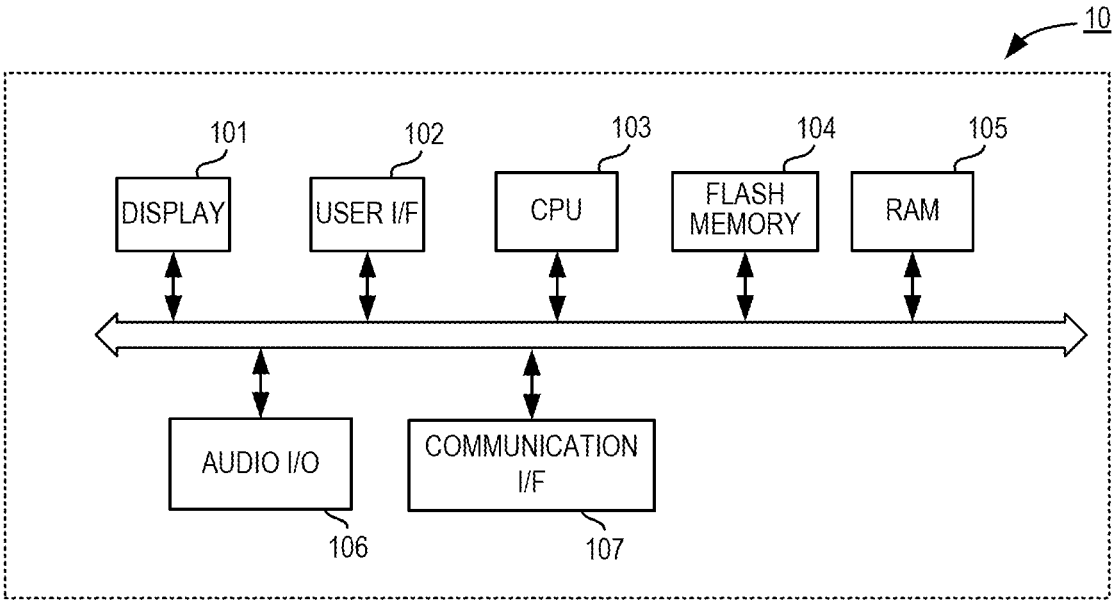
FIG. 2 is a block diagram showing a configuration of an audio device 10.

FIG. 2 is a block diagram showing a configuration of the audio device 10. The audio device 10 may include a display 101, a user interface (I/F) 102, a CPU 103, a flash memory 104, a RAM 105, an audio I/O 106, and a communication interface (I/F) 107.

The display 101 may be made of a plurality of LEDs, and displays various states of the audio device 10 such as a power-on state, for example. The user I/F 102 includes a power button and a measurement start button, for example. When a user presses the measurement start button, the audio device 10 executes the measurement method according to the present embodiment. Moreover, the user may issue measurement start instructions from a remote control of the audio device 10 or an application program installed in an information processing apparatus such as a smartphone to be connected to the audio device 10.

The CPU 103 reads a program stored in the flash memory 104, being a storage medium, to the RAM 105, and implements a predetermined function. For example, the CPU 103 decodes content data received from the communication I/F 107, and takes out an audio signal. The CPU 103 outputs the audio signal to the speakers 11 to 18 through the audio I/O 106.

In addition, the CPU 103 functions as a processing device. The CPU 103 outputs a measurement signal corresponding to a measurement sound, to the speakers 11 to 18. The CPU 103 receives a collected sound signal according to a sound collected with the microphone 20, through the audio I/O 106. The CPU 103, based on the measurement signal outputted to the speakers 11 to 18 and the collected sound signal received with the microphone 20, measures the acoustic characteristics of the speakers 11 to 18.

Figure 3:
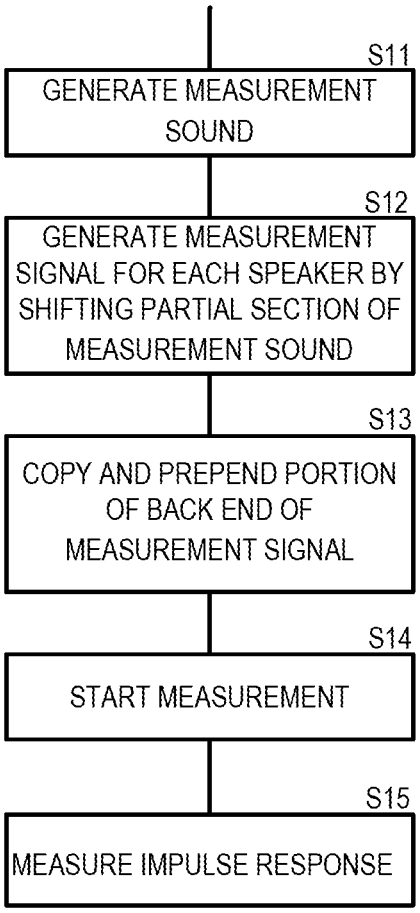
FIG. 3 is a flow chart showing an operation of the audio device 10.
Figure 4A:
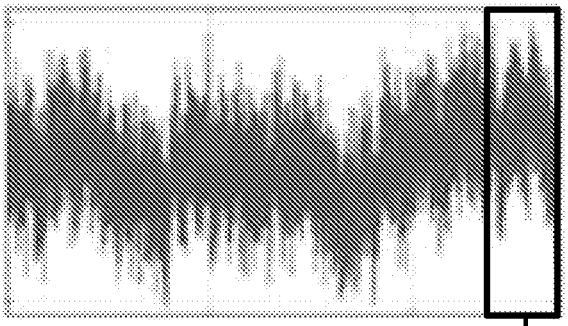
FIG. 4A is a diagram showing an amplitude waveform on a time axis of a measurement sound.

FIG. 3 is a flow chart showing an operation of the audio device 10. The audio device 10 performs an operation shown in FIG. 3, when taking measurement start instructions from a user, for example. First, the audio device 10 generates a measurement sound (S11). FIG. 4A is a diagram showing an amplitude waveform on the time axis of an example of the measurement sound. The measurement sound is pink noise, for example. However, the measurement sound is not limited to pink noise. The measurement sound may be white noise. Alternatively, the measurement sound may be any sound such as M sequence pseudo noise or a sweep wave.

A time length of the measurement sound is determined by a time length of the acoustic characteristics to be measured and the number of speakers (eight speakers in the present embodiment). For example, in a case in which the sampling frequency is 48 kHz and the required number of samples corresponding to the time length of the acoustic characteristics is 16384, the required number of samples corresponding to the time length of the measurement sound is 16384×8=131072.

Figure 4B:
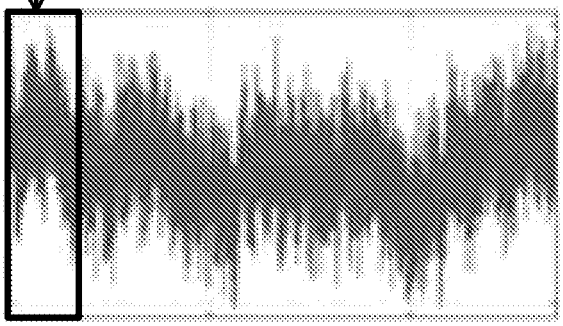
FIG. 4B is a diagram showing an amplitude waveform on the time axis of a measurement sound.

Subsequently, the audio device 10 generates a measurement signal for each speaker by shifting a partial section of the measurement sound (S12). For example, the audio device 10 moves a portion of the back end of the measurement sound shown in FIG. 4A to the front end, and generates the measurement sound as shown in FIG. 4B. The number of samples to be moved corresponds to the time length of the acoustic characteristics, and may be 16384, for example.

Figure 5A:
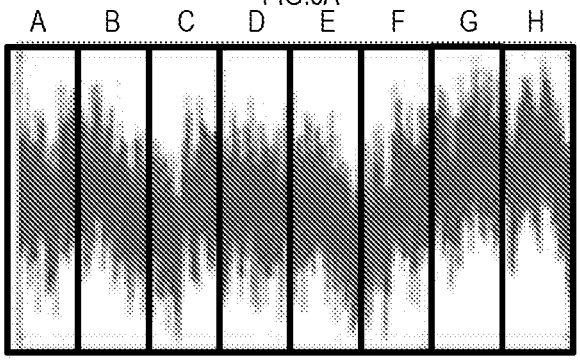
FIG. 5A is a diagram showing an amplitude waveform on the time axis of a measurement signal corresponding to a speaker 11.

FIG. 5A to FIG. 5D are diagrams showing example measurement signals for each speaker. FIG. 5A shows an example of a measurement signal corresponding to the speaker 11. The measurement signal shown in FIG. 5A is the same as the measurement sound shown in FIG. 4A, and the same as the example pink noise being the measurement sound generated in the processing of S11.

Figure 5B:
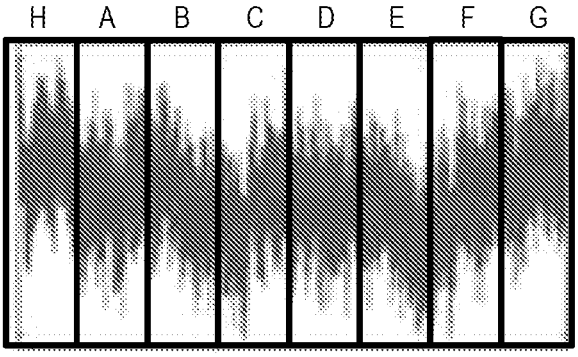
FIG. 5B is a diagram showing an amplitude waveform on the time axis of a measurement signal corresponding to a speaker 12.

FIG. 5B shows an example of a measurement signal corresponding to the speaker 12. The measurement signal of FIG. 5B is the same signal as a time base waveform shown in FIG. 4B. The measurement signal of FIG. 5B is a time base waveform obtained by moving a component H being a portion (e.g., 16384 samples) of the back end of the example pink noise generated in the processing of S11, to the front end.

Figure 5C:
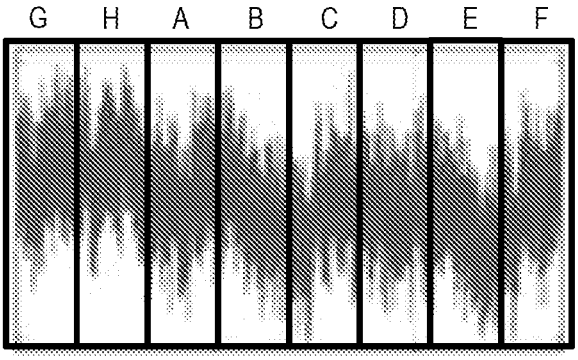
FIG. 5C is a diagram showing an amplitude waveform on the time axis of a measurement signal corresponding to a speaker 13.

FIG. 5C shows an example of a measurement signal corresponding to the speaker 13. The measurement signal of FIG. 5C is a time base waveform obtained by moving a component G being a portion (e.g., 16384 samples) of the back end of the measurement signal corresponding to the speaker 12 shown in FIG. 5B, to the front end.

Figure 5D:
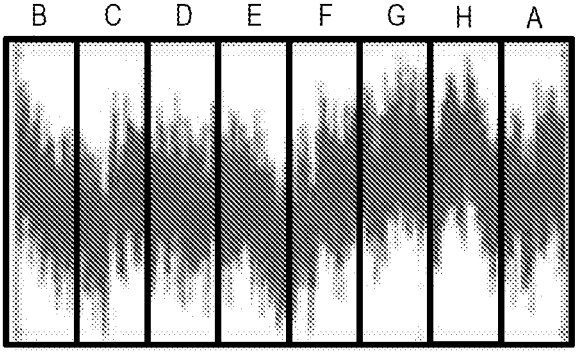
FIG. 5D is a diagram showing an amplitude waveform on the time axis of a measurement signal corresponding to a speaker 18.

FIG. 5D shows an example of a measurement signal corresponding to the speaker 18. The measurement signal of FIG. 5D is a time base waveform obtained by moving a component B being a portion (e.g., 16384 samples) of the back end of the measurement signal corresponding to the speaker 17, to the front end.

In such a manner, the audio device 10 moves a component, being a portion of the back end of the measurement signal, to the front end, and generates a measurement signal of each speaker. The component A to the component H correspond to the plurality of first measurement signals of the present disclosure, respectively. The measurement signal corresponding to each speaker disposes the component A to the component H in a different time zone on a time axis. The measurement signal corresponding to each speaker corresponds to the second measurement signal of the present disclosure.

Subsequently, the audio device 10, by copying and prepending a portion of the back end of the second measurement signal of each speaker, generates a third measurement signal (S13). FIG. 6A to FIG. 6D are diagrams showing a third measurement signal for each speaker.

Figure 6A:
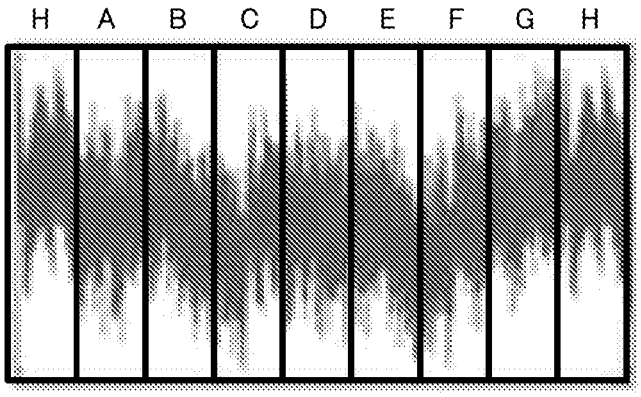
FIG. 6A shows a third measurement signal corresponding to the speaker 11.

FIG. 6A shows an example of a third measurement signal corresponding to the speaker 11. The third measurement signal corresponding to the speaker 11 is a signal obtained by copying and prepending the component H being a portion of the back end of the second measurement signals shown in FIG. 5A.

Figure 6B:
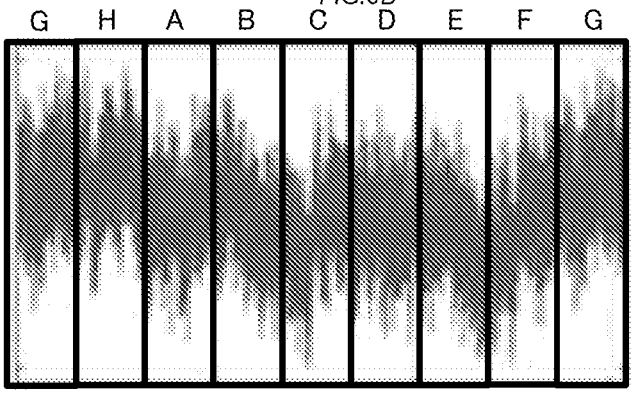
FIG. 6B shows a third measurement signal corresponding to the speaker 12.

FIG. 6B shows an example of a third measurement signal corresponding to the speaker 12. The third measurement signal corresponding to the speaker 12 is a signal obtained by copying and prepending the component G being a portion of the back end of the second measurement signals shown in FIG. 5B.

Figure 6C:
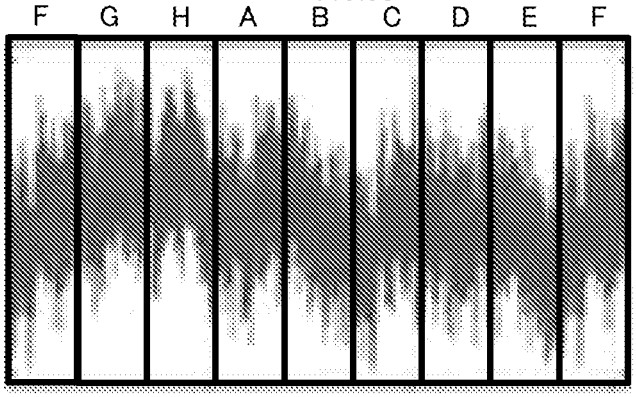
FIG. 6C shows a third measurement signal corresponding to the speaker 13.

FIG. 6C shows an example of a third measurement signal corresponding to the speaker 13. The third measurement signal corresponding to the speaker 13 is a signal obtained by copying and prepending the component F being a portion of the back end of the second measurement signals shown in FIG. 5C.

Figure 6D:
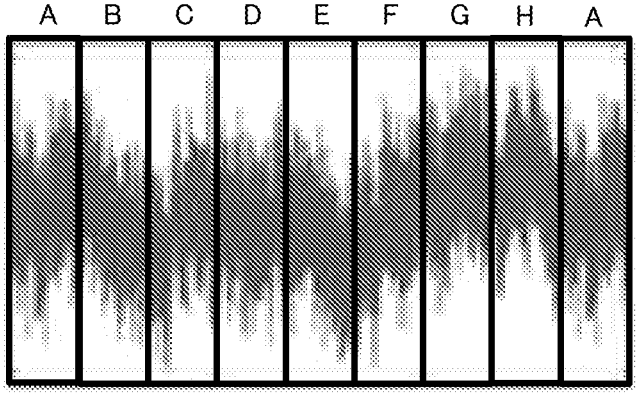
FIG. 6D shows a third measurement signal corresponding to the speaker 18.

FIG. 6D shows an example of a third measurement signal corresponding to the speaker 18. The third measurement signal corresponding to the speaker 18 is a signal obtained by copying and prepending the component A being a portion of the back end of the second measurement signals shown in FIG. 5D.

In such a manner, the audio device 10 moves a component being a portion (e.g., 16384 samples) of the back end of the second measurement signal to the front end, and generates a third measurement signal of each speaker. Such a third measurement signal is the same as a signal in a situation in which a signal at the back end of the second measurement signal wraps around to the front end. In short, the third measurement signal, although being a signal of one period, is synonymous with a signal after the second and subsequent periods of a periodic signal.

Subsequently, the audio device 10 starts measurement (S14). The audio device 10 outputs a respective third measurement signal to each of the speaker 11 to the speaker 18 simultaneously. In addition, at the same time as outputting the third measurement signal, the audio device 10 starts collecting (recording) sound, using the microphone 20.

Then, the audio device 10, based on the collected sound signal collected with the microphone 20 and the measurement sound (e.g., pink noise) generated in S11, measures an impulse response corresponding to the acoustic characteristics of each speaker (S15).

Figure 7A:
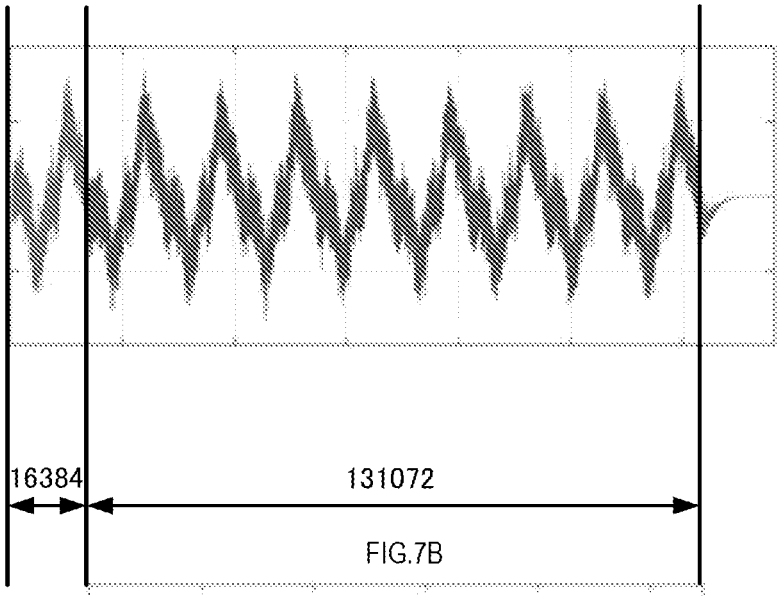
FIG. 7A shows a collected sound signal collected with a microphone 20.
Figure 7B:
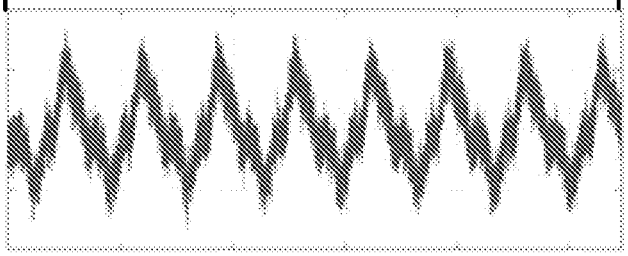
FIG. 7B shows a collected sound signal after 131072 samples are taken out from the collected sound signal collected with the microphone 20.

FIG. 7A shows an amplitude waveform on the time axis of a collected sound signal collected with the microphone 20. The audio device 10, as shown in FIG. 7A and FIG. 7B, removes a partial head (e.g., 16384 samples) from the collected sound signal collected with the microphone 20, and takes out a collected sound signal of, for example, 131072 samples corresponding to the time length of the measurement sound generated in S11.

For example, the audio device 10 obtains an impulse response by convolving the inverse function of the measurement sound generated in S11 to the collected sound signal. More specifically, the audio device 10 applies the Fourier transform to the measurement sound X(t) generated in S11 to obtain a frequency signal X(ω), and applies the Fourier transform to the collected sound signal Y(t) shown in FIG. 7B to obtain a frequency signal Y(ω). Then, a frequency signal H(ω) of the impulse response H(t) is represented by the following formula (1), based on the cross-spectral method.

$$H(\omega)=(\mathrm{conj}(Y(\omega))\cdot X(\omega))/(\mathrm{conj}(X(\omega))\cdot X(\omega)) \qquad \text{Formula (1)}$$

where conj (X(ω)) represents a conjugate complex number of X(ω), and conj(Y(ω)) represents a conjugate complex number of Y(ω).

The audio device 10 is able to obtain the impulse response H(t) by applying the inverse Fourier transform to the frequency signal H(ω) obtained by the above formula (1).

Figure 8:
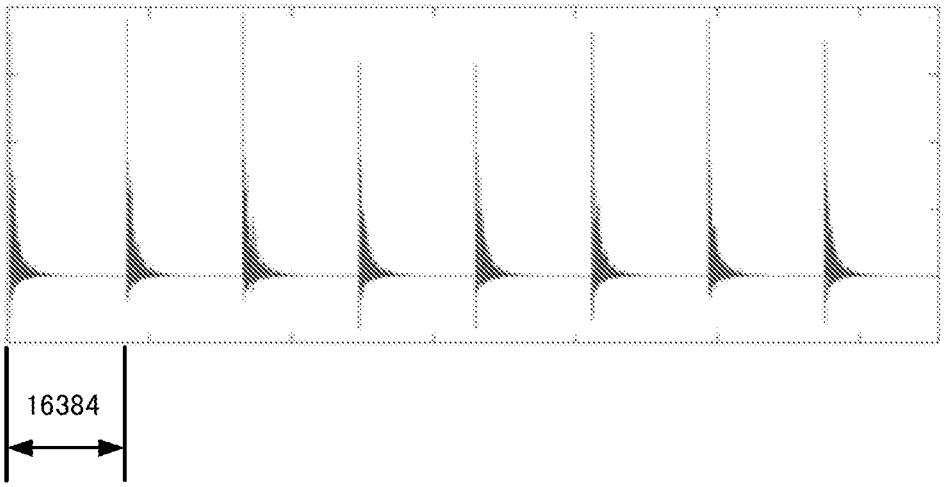
FIG. 8 is a diagram showing an amplitude waveform on the time axis of an impulse response H(t).

FIG. 8 is a diagram showing an amplitude waveform on the time axis of an impulse response H(t). The collected sound signal collected with the microphone 20 includes a plurality of third measurement signals simultaneously outputted from the speakers 11 to 18. The plurality of third measurement signals, as shown in FIG. 5A to FIG. 5D, dispose each of the component A to the component H in a different time zone on a time axis. For example, a signal obtained by removing the head 16384 samples of the third measurement signal outputted from the speaker 11 is the same as the measurement sound generated in S11. Therefore, as shown in FIG. 8, the head 16384 samples of the impulse response H(t) correspond to the impulse response of the output third measurement signal outputted from the speaker 11.

A signal obtained by removing, for example, the head 16384 samples of the third measurement signal outputted from the speaker 12 is a signal obtained by temporally shifting the measurement sound generated in S11 by 16384 samples. Therefore, the impulse response of the third measurement signal outputted from the speaker 12 appears at a position shifted backward only by 16384 samples, for example. Similarly, the impulse response of the third measurement signal outputted from each speaker appears in a different time zone on a time axis.

As a result, the audio device 10 is able to obtain acoustic characteristics of each of the speaker 11 to the speaker 18 by taking out, for example, 16384 samples of the impulse response H(t).

In such a manner, the measurement method shown in the present embodiment is able to obtain the impulse response (e.g., the acoustic characteristics) of a plurality of speakers, by a single measurement. While the number of speakers according to the present embodiment is eight, the number of speakers may be further more or may be less. The measurement method shown in the present embodiment is able to obtain the impulse response (the acoustic characteristics) of a plurality of speakers, by a single measurement, regardless of the number of speakers. Accordingly, the measurement method shown in the present embodiment is able to reduce an increase in the number of times of measurement even when the number of speakers is increased.

It is to be noted that the frequency signal H(ω) of the impulse response shown in the above formula (1) is premised on the principle of circular convolution in which the impulse response H(t) is repeated periodically on a time axis. Therefore, a measurement signal (a measurement sound to be outputted from a speaker) being a signal of one period is unable to satisfy the principle of circular convolution. However, in the present embodiment, the third measurement signal to be outputted from each speaker, since being generated such that a signal at the back end of the second measurement signal wraps around to the front end, is able to be treated in the same manner as the signal after the second and subsequent periods of the periodic signal. Therefore, the measurement method shown in the present embodiment is able to satisfy the principle of circular convolution and correctly obtain the frequency signal H(ω) of an impulse response by the above formula (1).

Moreover, it is not essential to remove the head, e.g., 16384 samples of the collected sound signal collected with the microphone 20. However, in such a case, an extra signal of, for example, 16384 samples is included at the head of the collected sound signal, so that all the impulse responses corresponding to the acoustic characteristics of each speaker, among impulse responses H(t), are shifted backward only by, for example, 16384 samples. In such a case, the audio device 10 may take out a collected sound signal of, for example, 1347456 samples that is longer by, e.g., 16384 samples than the time length of the measurement sound generated in S11, among the collected sound signals collected with the microphone 20, and may obtain an impulse response.

The time length of each of the plurality of first measurement signals (the component A to the component H) may be the same as the time length of the acoustic characteristics of to be measured and may be longer than the time length of the acoustic characteristics. For example, in a case in which the audio device 10 and the speakers 11 to 18 are connected by wireless communication, timing at which the speakers 11 to 18 output a third measurement signal may shift. In a case in which the time length of each of the plurality of first measurement signals (the component A to the component H) is the same as the time length of the acoustic characteristics, and the timing at which the third measurement signal is outputted shifts, impulse responses corresponding to respective speakers among the impulse responses H(t) overlap on a time axis. However, in a case in which the time length of each of the plurality of first measurement signals (the component A to the component H) is longer than the time length of the acoustic characteristics, the impulse responses corresponding to respective speakers among the impulse responses H(t) do not overlap on a time axis, and thus the impulse response of each speaker is able to be taken out. In addition, in a case in which the time length of each of the plurality of first measurement signals (the component A to the component H) is longer than the time length of the acoustic characteristics, the impulse responses corresponding to respective speakers do not overlap on a time axis even when the third measurement signal is not simultaneously outputted from all the speakers 11 to 18, and the impulse response of each speaker is able to be taken out.

In the above embodiments, the audio device 10 may generate a measurement sound (a fourth measurement signal) of, for example, pink noise of a time length of the acoustic characteristics and a time length based on the number of speakers, and may generate the second measurement signal by moving the component A to the component H corresponding to the first measurement signal of each speaker, among the pink noise being the fourth measurement signal, to each time zone. However, the audio device 10 may generate a first measurement signal of each speaker individually, and may generate a second measurement signal by arranging generated first measurement signals on a time axis. In such a case as well, the audio device 10 generates a second measurement signal by disposing a plurality of first measurement signals in respective different time zones on a time axis.

Finally, the descriptions of the embodiments of the present disclosure are illustrative in all points and should not be construed to limit the present disclosure. The scope of the present disclosure is defined not by the foregoing embodiments but by the following claims for patent. Further, the scope of the present disclosure includes the scopes of the claims for patent and the scopes of equivalents. For example, the audio device, the microphone, and the speaker may be built into one housing. In this case as well, the audio device may output a sound according to a measurement signal from the built-in speaker, and may collect the sound according to a measurement signal with the built-in microphone. In addition, the number of microphones may be not only one but two or more.

What is claimed is:

1. A measurement method of measuring acoustic characteristics of a plurality of speakers, the measurement method comprising:

generating a plurality of second measurement signals by disposing a plurality of first measurement signals corresponding to each of the plurality of speakers, in respective different time zones on a time axis;

generating a plurality of third measurement signals by copying a portion of a back end of each of the plurality of second measurement signals and adding the portion of the back end of each of the plurality of second measurement signals to a front end of each of the plurality of second measurement signals;

outputting a plurality of sounds according to each of the plurality of third measurement signals from each of the plurality of speakers;

collecting the plurality of sounds output from each of the plurality of speakers with a microphone as a collected sound signal; and calculating a plurality of impulse responses corresponding to the plurality of first measurement signals, based on the collected sound signal collected with the microphone and the plurality of third measurement signals.

2. The measurement method according to claim 1, wherein a time length of each of the plurality of first measurement signals corresponds to a time length of the acoustic characteristics.

3. The measurement method according to claim 1, wherein a time length of each of the plurality of first measurement signals is longer than a time length of the acoustic characteristics.

4. The measurement method according to claim 1, further comprising:

generating a fourth measurement signal; and generating the plurality of second measurement signals by moving a plurality of components of the fourth measurement signal corresponding to the plurality of the first measurement signals to the respective different time zones on the time axis.

5. The measurement method according to claim 1, wherein the plurality of first measurement signals include pink noise.

6. The measurement method according to claim 1, wherein the plurality of first measurement signals include white noise.

7. The measurement method according to claim 1, further comprising calculating the plurality of impulse responses based on a cross-spectral method.

8. A measurement apparatus for measuring acoustic characteristics of a plurality of speakers, the measurement apparatus comprising:

a microphone; and a processing device configured to:

generate a plurality of second measurement signals by disposing a plurality of first measurement signals corresponding to each of the plurality of speakers in respective different time zones on a time axis;

generate a plurality of third measurement signals by copying a portion of a back end of each of the plurality of second measurement signals and adding the portion of the back end of each of the plurality of second measurement signals to a front end of each of the plurality of second measurement signals;

causing a plurality of sounds according to each of the plurality of third measurement signals to be output from each of the plurality of speakers; and calculate a plurality of impulse responses corresponding to the plurality of first measurement signals, based on a collected sound signal collected with the microphone, and the plurality of third measurement signals, wherein the microphone is configured to collect the plurality of sounds output from each of the plurality of speakers as the collected sound signal.

9. The measurement apparatus according to claim 8, wherein a time length of each of the plurality of first measurement signals corresponds to a time length of the acoustic characteristics.

10. The measurement apparatus according to claim 8, wherein a time length of each of the plurality of first measurement signals is longer than a time length of the acoustic characteristics.

11. The measurement apparatus according to claim 8, wherein the processing device is configured to:

generate a fourth measurement signal; and generate the plurality of second measurement signals by moving a plurality of components of the fourth measurement signal corresponding to the plurality of the first measurement signals to the respective different time zone on the time axis.

12. The measurement apparatus according to claim 8, wherein the plurality of first measurement signals include pink noise.

13. The measurement apparatus according to claim 8, wherein the plurality of first measurement signals include white noise.

14. The measurement apparatus according to claim 8, wherein the processing device is configured to:

calculate the plurality of impulse responses based on a cross-spectral method.

* * * * *